US011466548B2

(12) United States Patent
Xiao

(10) Patent No.: US 11,466,548 B2
(45) Date of Patent: Oct. 11, 2022

(54) DOWNHOLE LINEAR PUMP SYSTEM

(71) Applicant: SAUDI ARABIAN OIL COMPANY, Dhahran (SA)

(72) Inventor: Jinjiang Xiao, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 207 days.

(21) Appl. No.: 16/893,572

(22) Filed: Jun. 5, 2020

(65) Prior Publication Data

US 2021/0381349 A1 Dec. 9, 2021

(51) Int. Cl.

| | |
|---|---|
| ***E21B 43/12*** | (2006.01) |
| ***F04B 47/06*** | (2006.01) |
| ***E21B 34/08*** | (2006.01) |
| ***F04B 15/02*** | (2006.01) |
| ***F04B 17/03*** | (2006.01) |

(Continued)

(52) U.S. Cl.

CPC ..... *E21B 43/128* (2013.01); *E21B 34/08* (2013.01); *F04B 15/02* (2013.01); *F04B 17/03* (2013.01); *F04B 19/22* (2013.01); *F04B 53/1005* (2013.01); *E21B 2200/04* (2020.05)

(58) Field of Classification Search

CPC ..... F04B 17/03; F04B 19/22; F04B 53/1005; F04B 47/06; E21B 43/128

See application file for complete search history.

(56) References Cited

U.S. PATENT DOCUMENTS 1,713,219 A * 5/1929 Eisenhauer ..... F04B 47/02 417/415
5,960,875 A 10/1999 Beauquin et al.
6,086,339 A 7/2000 Jeffrey (Continued)

FOREIGN PATENT DOCUMENTS

CN 201180636 Y 1/2009
CN 208203525 U 12/2018

(Continued)

OTHER PUBLICATIONS

Cui, Junguo et al., "Long Stroke Pumping Unit Driven By Low-Speed Permanent Magnet Synchronous Motor", SPE-173698-MS; Society of Petroleum Engineers, Nov. 2014 (9 pages).

(Continued)

*Primary Examiner* — Kenneth L Thompson
(74) *Attorney, Agent, or Firm* — Osha Bergman Watanabe & Burton LLP

(57) ABSTRACT

A pump system includes a pump barrel disposed within a housing. A standing valve is disposed at a first end of a pump chamber defined within the pump barrel. A traveling valve is disposed at a second end of the pump chamber. The traveling valve is movable relative to along an axial axis and relative to the housing. A motor stator is disposed inside the housing. produces a rotating electromagnetic field upon receiving electrical power. A motor rotor is rotatably supported within the motor stator and rotates about the axial axis in response to the rotating electromagnetic field. A traveling plug is coupled to the valve body of the traveling body and arranged to move linearly along the axial axis in response to rotation of the motor rotor. The pump system can be disposed in a wellbore to lift fluids up a tubing in the wellbore.

18 Claims, 7 Drawing Sheets

(51) Int. Cl.
*F04B 19/22* (2006.01)
*F04B 53/10* (2006.01)

(56) References Cited

U.S. PATENT DOCUMENTS

| | | | | |
|---|---|---|---|---|
| 6,155,792 | A | 12/2000 | Hartley et al. | |
| 8,226,383 | B2 * | 7/2012 | Henry | F04B 47/06 166/329 |
| 9,447,788 | B2 * | 9/2016 | Henry | F04B 47/02 |
| 9,726,166 | B2 * | 8/2017 | Tetzlaff | F04B 9/047 |
| 9,885,353 | B2 * | 2/2018 | Tetzlaff | E21B 43/128 |
| 10,125,589 | B2 | 11/2018 | Zowarka et al. | |
| 10,232,109 | B2 | 3/2019 | Deak et al. | |
| 10,400,761 | B2 | 9/2019 | Robison et al. | |
| 11,162,490 | B2 * | 11/2021 | Leonov | E21B 43/128 |
| 2002/0189805 | A1 | 12/2002 | Howard | |
| 2002/0197174 | A1 | 12/2002 | Howard | |
| 2005/0109516 | A1 | 5/2005 | Wilson et al. | |
| 2008/0080991 | A1 | 4/2008 | Yuratich et al. | |
| 2014/0105759 | A1 | 4/2014 | Henry et al. | |
| 2014/0271264 | A1 | 9/2014 | Florindi et al. | |
| 2016/0169215 | A1 | 6/2016 | Tetzlaff et al. | |
| 2016/0265521 | A1 | 9/2016 | Butler | |
| 2017/0175502 | A1 | 6/2017 | Zhao et al. | |
| 2017/0284177 | A1 | 10/2017 | Khachaturov et al. | |
| 2017/0314546 | A1 | 11/2017 | Minish et al. | |
| 2017/0321695 | A1 | 11/2017 | Head et al. | |

FOREIGN PATENT DOCUMENTS

| | | | |
|---|---|---|---|
| CN | 209510602 | U | 10/2019 |
| CN | 110485971 | A | 11/2019 |
| WO | 2016/057330 | A1 | 4/2016 |
| WO | 2017117141 | A1 | 7/2017 |

OTHER PUBLICATIONS

Spivey, Sebastian and Darcey O'How, "Long-Stroke Rod Pumping Systems LSPS in High-Volume Unconventional Applications", SPE-192497-MS; Society of Petroleum Engineers, Nov. 2018 (18 pages).
International Search Report for corresponding International Application No. PCT/US2020/037235, dated Feb. 9, 2021 (6 pages).
Written Opinion for corresponding International Application No. PCT/US2020/037235, dated Feb. 9, 2021 (9 pages).

* cited by examiner

DOWNHOLE LINEAR PUMP SYSTEM

BACKGROUND

Sucker rod pump, or beam pump, is a positive displacement pump that is commonly used in the oil and gas industry to lift hydrocarbons from a subsurface producing zone to the surface. The surface components of the pump system generally include a rotary prime mover, commonly a three-phase induction motor, a gear reducer, a crank, a beam arrangement that converts a high speed rotation into a low speed linear motion of a polished rod, and a stuffing box containing packing elements that seal dynamically around the polished rod. The downhole components of the pump system include a sucker rod and a linear reciprocating pump comprised of a barrel, a plunger, a standing valve, and a traveling valve. Typical pump designs have the plunger moving inside the stationary barrel. Less commonly is a design where the barrel moves while the plunger is stationary. The sucker rod is coupled at one end to the polished rod and at the other end to the pump and thereby translates motion of the polished rod to motion of the plunger or barrel, depending on the pump design.

Sucker rod pumping can produce moderate production rates from shallow depths and smaller production rates from intermediate depths. Operating parameters to control production rates include stroke speed (measured as stroke per minutes, or SPM) and stroke length. Stroke speed is typically in a range from 2 to 15 SPM. Stroke length can vary from 50 inches to 150 inches. Higher stroke speed can accelerate fatigue and increase rod and tubing wear. On the other hand, higher stroke length can increase production rate. Consequently, long stroke rod pump systems have been developed to reduce SPM and increase stroke length. Some long stroke rod pumps can provide stroke length of up to 360 inches and provide a pumping capacity in the range of 2000 to 5000 barrels per day (BPD), depending on installation depth. In comparison with conventional rod pumps, the long stroke design typically has advantages of increased reliability, i.e., reduced cycles minimize rod and tubing wear, especially in deviated wellbores with high dogleg severity, longer run life, and better efficiency.

Despite the ubiquity of sucker rod pumps in the industry, there are certain drawbacks with the sucker rod pump. One drawback is the relatively large surface footprint of the pump, which makes it impractical for offshore applications. Another drawback is the challenge associated with applications in deep wells with highly deviated wellbore, where the long sucker rod can rub against the production tubing, causing friction, rod damage, and tubing failure. In addition, the use of a long rod running from the surface to the downhole pump contributes to energy loss and low system efficiency. Surface driven rod pump systems consume a significant amount of steel (on average, one rod pumping system uses 30 tons of steel), representing an environmental concern. Finally, possible leakage of potentially toxic fluids from the stuffing box is an environmental concern.

SUMMARY

A system includes a housing having a first end corresponding to a pump intake and a second end corresponding to a pump discharge. The system includes a pump barrel disposed within the housing. The pump barrel defines a pump chamber. The system includes a standing valve disposed at a first end of the pump chamber. The standing valve has a valve body that is stationary relative to the housing.

The system includes a traveling valve disposed at a second end of the pump chamber. The traveling valve has a valve body that is movable relative to the housing and along an axial axis. The system includes a motor stator that is disposed within the housing. The motor stator receives electrical power and produces a rotating electromagnetic field from the electrical power. The system includes a motor rotor rotatably supported within the motor stator. The motor rotor has characteristics to rotate about the axial axis in response to the rotating electromagnetic field. The system includes a traveling plug that is coupled to the valve body of the traveling valve and arranged to move linearly along the axial axis in response to rotation of the motor rotor. The motor rotor may include a rotor body having a bore and a first threaded surface exposed to the bore. The traveling plug may be disposed within the bore. The traveling plug may have a second threaded surface in opposing relation to the first threaded surface and threadedly engaged with the first threaded surface. The traveling plug may have at least one orifice providing a path for passage of fluids from the pump intake into a space adjacent to the traveling valve. The system may include an actuator arm coupling the traveling plug to the traveling valve. The actuator arm may be disposed in the space adjacent to the traveling valve, the space may be in communication with the pump intake through the at least one orifice in the traveling plug, and the actuator arm may include at least one fluid path connecting the space to an orifice in the valve body of the traveling valve. The valve body of the standing valve may be coupled to the pump barrel, and the pump barrel may extend into the bore of the rotor body. The valve body of the traveling valve may be coupled to the pump barrel, the pump barrel may be coupled to the traveling plug to move with the traveling plug, and the valve body of the standing valve may be coupled to the housing. The rotor may include one or more permanent magnets carried by the rotor body. The stator may include windings and lamination. The windings and lamination may be encapsulated in an electrically insulating material. The system may include a motor drive to supply the electrical power to the windings. The motor drive may include a three-phase alternating current variable speed drive.

A system includes a tubing disposed in a wellbore traversing a producing zone in a subsurface. The system includes a downhole pump system disposed in the wellbore and positioned to lift formation fluids from the producing zone up the tubing. The downhole pump system includes a housing having a first end corresponding to a pump intake and a second end corresponding to a pump discharge; a pump barrel disposed within the housing, the pump barrel defining a pump chamber; a standing valve disposed at a first end of the pump chamber, the standing valve having a valve body that is stationary relative to the housing; a traveling valve disposed at a second end of the pump chamber, the traveling valve having a valve body that is movable relative to the housing and along an axial axis; a motor stator disposed within the housing, the motor stator to receive electrical power and produce a rotating electromagnetic field from the electrical power; a motor rotor rotatably supported within the stator, the motor rotor having characteristics to rotate about the axial axis in response to the rotating electromagnetic field; and a traveling plug coupled to the valve body of the traveling valve and arranged to move linearly along the axial axis in response to rotation of the motor rotor. The system includes a motor drive positioned at a surface location above the wellbore. The motor drive supplies electrical power to the stator. The motor rotor may include a stator body having a bore. The traveling plug may be disposed within the bore. The rotor body may have a first threaded surface exposed to the bore. The traveling plug may have a second threaded surface in opposing relation to the first threaded surface and threadedly engaged with the first threaded surface. The motor rotor may include one or more permanent magnets carried by the rotor body. The motor stator may include a plurality of windings and lamination. The system may include an actuator arm connecting the traveling plug to the valve body of the traveling valve. The actuator arm may be disposed in a space between the traveling plug and the traveling valve. The space may be fluidly connected to the pump intake through at least one orifice in the traveling plug. The actuator arm may include at least one fluid path connecting the space to an orifice in the valve body of the traveling valve. In one case, the standing valve may be coupled to the pump barrel. In another case, the valve body of the traveling valve may be coupled to the pump barrel, the pump barrel may be coupled to the traveling plug, and the valve body of the standing valve may be coupled to the housing. The housing may be coupled to the tubing.

A method includes disposing a pump inside a wellbore, producing a rotating electromagnetic field by a motor stator of the pump, rotating a motor rotor of the pump by the rotating electromagnetic field about an axial axis, transferring the rotation of the motor rotor to a linear motion along the axial axis of a traveling plug of the pump that is disposed within a bore of and threadedly engaged with the motor rotor, moving a traveling valve of the pump relative to a standing valve of the pump by the linear motion of the traveling plug, and alternately opening and closing the traveling valve and the standing valve during the moving of the valve body of the traveling valve relative to the standing valve to receive fluid into a pump chamber between the traveling valve and the standing valve and discharge fluid from the pump chamber.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
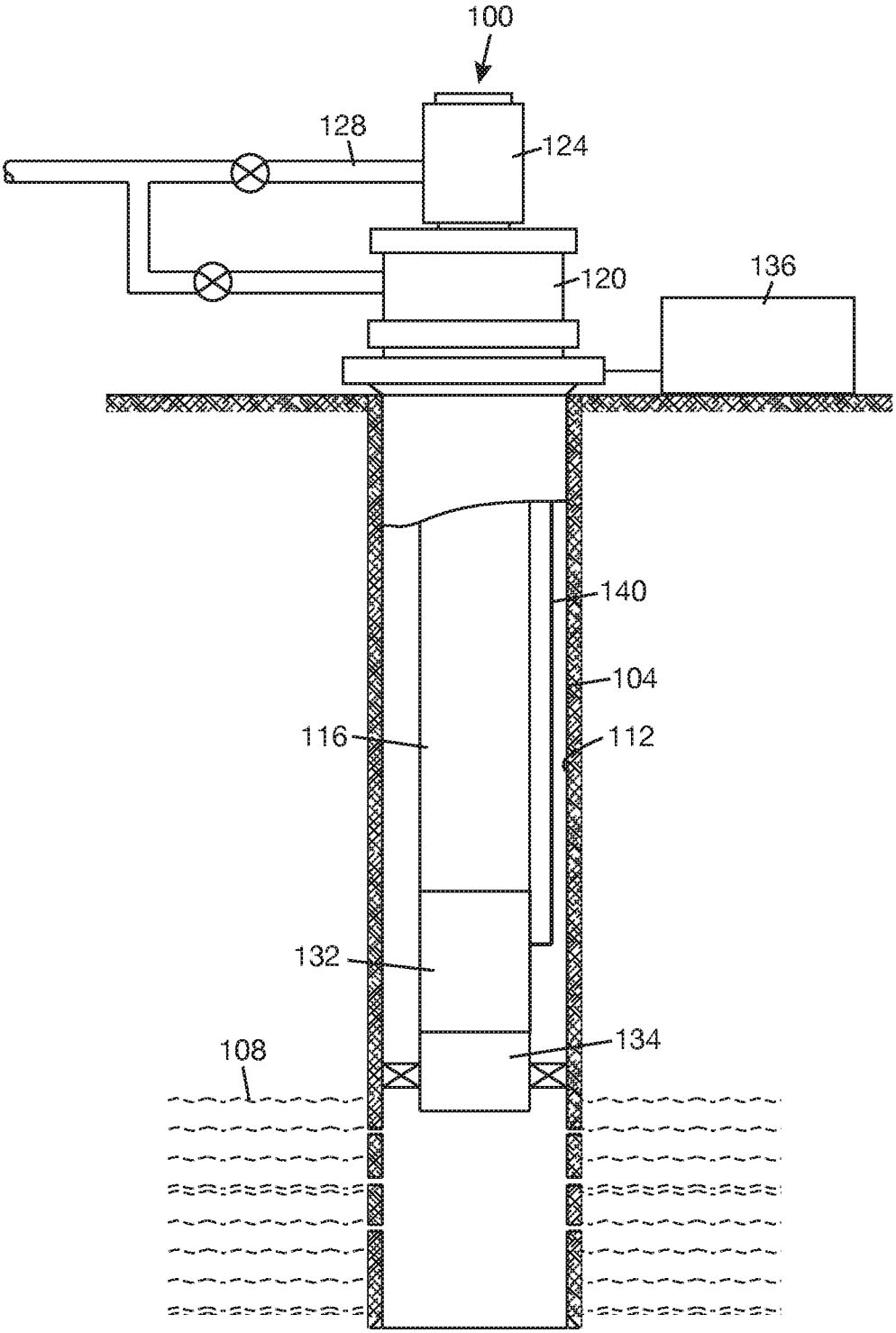
FIG. 1 is a schematic diagram showing a downhole pump disposed in a wellbore.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

FIG. 1 shows an exemplary well system 100 relative to a wellbore 104 traversing a subsurface producing zone 108. A casing 112 may be installed in wellbore 104. Perforations may be formed in casing 112 to allow formation fluids, such as hydrocarbons, to flow from producing zone 108 into wellbore 104. A tubing 116 is disposed in wellbore 104 to convey formation fluids from producing zone 108 to the surface. Tubing 116 may be suspended in wellbore 104 by means of a tubing hanger (not shown) in a surface wellhead 120. A pumping tee 124 may be mounted on surface wellhead 120 and may be fluidly connected to tubing 116. Pumping tee 124 includes a side outlet that is fluidly connected to a flowline 128, which may be connected to surface storage tank(s) (not shown).

A downhole linear pump system 132 is installed in tubing 116 in a position to lift formation fluids from producing zone 108 up tubing 116. Downhole linear pump system 132 includes a linearly reciprocating pump and an integrated electric motor to operate the pump. A motor drive system 136 is positioned at the surface and connected to the electric motor of downhole pump 132 by a cable 140. In one example, motor drive system 136 includes a three-phase variable speed drive (VSD) to output three-phase AC power. VSDs, also referred to as variable frequency drives (VFDs), are known in the art. Motor drive system 136 may include a controller to control the three-phase VSD to output three-phase AC power at frequencies corresponding to predetermined speeds of rotation. Such predetermined speeds of rotation may depend on desired fluid production rates. Motor drive 136 can control the rotation direction of the electric motor of downhole pump 132 in order to achieve upward and downward strokes of the pump.

A downhole sensor sub 134 may be arranged to take measurements at the pump intake. For example, downhole sensor sub 134 may include downhole sensors to measure fluid temperature and pressure, motor temperature and vibration, and other parameters related to operation of the pump as known, for example, in electrical submersible pump (ESP) systems. Sensory data collected by downhole sensor sub 134 may be transmitted to the surface via cable 140. In some cases, motor drive 136 may receive the sensory data, and the controller of motor drive 136 may adjust the electrical power delivered to the motor of downhole linear pump system 132 based on the sensory data.

Figure 2:
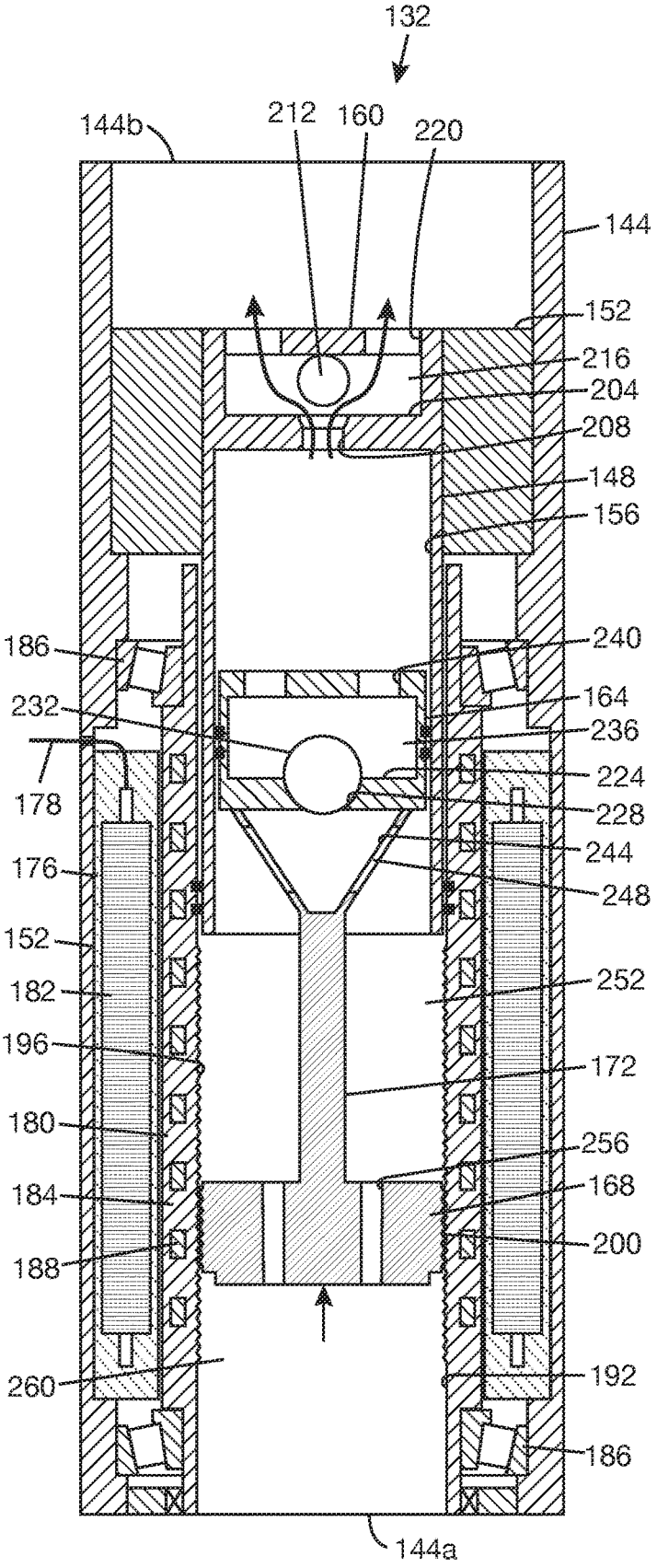
FIG. 2 is a cross-sectional view of the downhole pump of FIG. 1 according to one illustrative implementation.

Referring to FIG. 2, downhole linear pump system 132 includes a housing 144, which can be coupled to tubing 116 (in FIG. 1). Housing 144 may be generally cylindrical or tubular in shape. A lower end 144*a* of housing 144 may correspond to a pump intake, i.e., where formation fluids enter the downhole linear pump system 132, and an upper end 144*b* of housing 144 may correspond to a pump discharge, i.e., where formation fluids exit the downhole linear pump system 132. In one implementation, a pumping component of downhole pump 132 includes a pump barrel 148 disposed inside housing 144. Pump barrel 148 may be generally cylindrical or tubular in shape. Pump barrel 148 may be coaxial with housing 144. Pump barrel 148 is coupled to housing 144, e.g., by attachment flange 152, and fixed relative to housing 144. Pump barrel 148 has a pump chamber 156. A standing valve 160 is disposed at an upper end of pump chamber 156. Standing valve 160 may be attached to, or otherwise fixed to, an upper end of pump barrel 148. In general, a valve body of standing valve 160 is stationary relative to housing 144. A traveling valve 164 is disposed at a lower end of pump chamber 156. Traveling valve 164 is axially aligned with standing valve 160, with pump chamber 156 in between the valves. A valve body of traveling valve 164 is movable within and along an axial axis of pump barrel 148, while standing valve 160 is stationary. Pump chamber 156 contracts or expands with motion of traveling valve 164. A traveling plug 168 provides the linear motion that is transferred to traveling valve 164 in order to enable traveling valve 164 to move axially within pump barrel 148.

In one implementation, a motor component of downhole linear pump system 132 includes a stator 176 and a rotor 180, which are disposed inside housing 144. Stator 176 includes windings and lamination, generally depicted at 182, to produce a rotating electromagnetic field. Windings may be, for example, insulated copper wires. Lamination may be made of, for example, thin sheets of silicon steel. Stator 176 may be vacuum filled with epoxy or other electrically insulating material and fully encapsulated in a can to improve its electrical reliability. The windings of stator 176 may have a terminal 178 that may be connected to a cable from a motor drive (e.g., cable 140 in FIG. 1). Rotor 180 is disposed within a bore of stator 176. Rotor 180 includes an annular rotor body 184 carrying one or more permanent magnets 188. In one example, rotor body 184 can include a silicon steel lamination, permanent magnets arranged on the lamination, and a magnetically transparent sleeve that protects the permanent magnets. Permanent magnets 188 may be embedded in rotor body 184 for protection from the outside environment. Stator 176 and rotor 180 may have a common axial axis. Permanent magnets 188 of rotor 180 may be arranged to be coaxial with the windings and lamination 182 of stator 176. Rotor 180 rotates within stator 176 in response to the rotating electromagnetic field produced by stator 176. Rotation of rotor 180 may be supported by bearings 186, which may be tapered roller bearings as shown or other type of bearing known in the art. There may be an air gap between opposing surfaces of stator 176 and rotor 180 to prevent rotor 180 from rubbing against stator 176 as the rotor rotates. This air gap should be as small as practical to minimize magnetic flux leakage.

Annular rotor body 184 has a central bore 192. At least a portion of an inner surface of rotor body 184 defining central bore 192 has a helical thread 196. Traveling plug 168 is disposed within bore 192. Traveling plug 168 may have a disc shape or other shape to occupy a portion of bore 192. At least a portion of an outer surface of traveling plug 168 has a helical thread 200 that is complementary to threads 196 of rotor body 184. Traveling plug 168 is threaded into rotor body 184. As rotor 180 rotates forward or backward in response to the electromagnetic field produced by stator 176, traveling plug 168 will move up or down along an axial axis of rotor 180. The mechanism to lock the traveling plug from rotation can be a locking key design that is fixed to housing 144 or pump barrel 148. For example, pump barrel 148 may have a slot/groove design so that traveling valve 164 and traveling plug 168 are prevented from rotation due to being able to move only linearly up and down. Pump barrel 148 is arranged to be coaxial with rotor 180. In one implementation, a lower portion of pump barrel 148 extends into bore 192 of rotor body 184, and traveling valve 164 is axially aligned with traveling plug 168. An actuator arm 172 connects traveling valve 164 to traveling plug 168, allowing motion of traveling plug 168 to be transferred to traveling valve 164.

Standing valve 160 includes a valve seat 204 having an inlet orifice 208. A valve element 212, such as a ball element, is arranged to selectively open and close inlet orifice 208. Valve element 212 sits on valve seat 204 and closes inlet orifice 208 when the pressure in a space 216 above valve seat 204 is higher than a pressure in pump chamber 156. Valve element 212 lifts off valve seat 204 and opens inlet orifice 208 when the pressure in space 216 is below the pressure in pump chamber 156. When inlet orifice 208 is open, fluid can flow from pump chamber 156 into space 216 within valve 160. Standing valve 160 includes one or more outlet orifices 220 to allow fluid in space 216 to exit the valve and flow to pump discharge 144*b*.

Traveling valve 164 includes a valve seat 224 having an inlet orifice 228. A valve element 232, such as a ball element, is arranged to selectively open and close inlet orifice 228. Valve element 232 sits on valve seat 224 and closes inlet orifice 228 when a pressure in a space 236 above valve seat 224 is higher than a pressure below valve seat 224. Space 236 is exposed to pump chamber 156 through one or more outlet orifices 240 in traveling valve 164. Valve element 232 lifts off valve seat 224 and opens inlet orifice 228 when the pressure below valve seat 224 is higher than the pressure in space 236. When inlet orifice 228 is open, fluid can flow from below valve seat 224 into space 236 and then exit from space 236 into pump chamber 156. Actuator arm 172 may provide at least one flow path, e.g., chamber 244 and orifice(s) 248, from a space 252 above traveling plug 168 to inlet orifice 228. Traveling plug 168 includes one or more orifices 256 for passage of fluids coming from pump intake 144*a* to space 252.

In operation, downhole linear pump system 132 is disposed in a wellbore as shown in FIG. 1. A motor drive (e.g., 136 in FIG. 1) controls stator 176 to produce a rotating electromagnetic field that results in rotation of rotor 180 in a first direction. After a pump stroke has been completed by rotating rotor 180 in the first direction, the motor drive stops stator 176 from producing a rotating electromagnetic field, which stops rotation of rotor 180 in the first direction. Then, the motor drive controls stator 176 to produce a rotating electromagnetic field that results in rotation of rotor 180 in a second direction that is a reverse of the first direction. After another pump stroke has been completed by rotating rotor 180 in the second direction, the motor drive stops stator 176 from producing a rotating electromagnetic field, which stops rotation of rotor 180 in the second direction. The motor drive repeats the sequence of rotating rotor 180 in a first direction, stopping rotation of rotor 180, and then rotating rotor 180 in a second direction that is a reverse of the first direction, and stopping rotation of rotor 180 for each pump cycle. As rotor 180 rotates, traveling plug 168 moves up or down, depending on the rotational direction of rotor 180.

Figure 3:
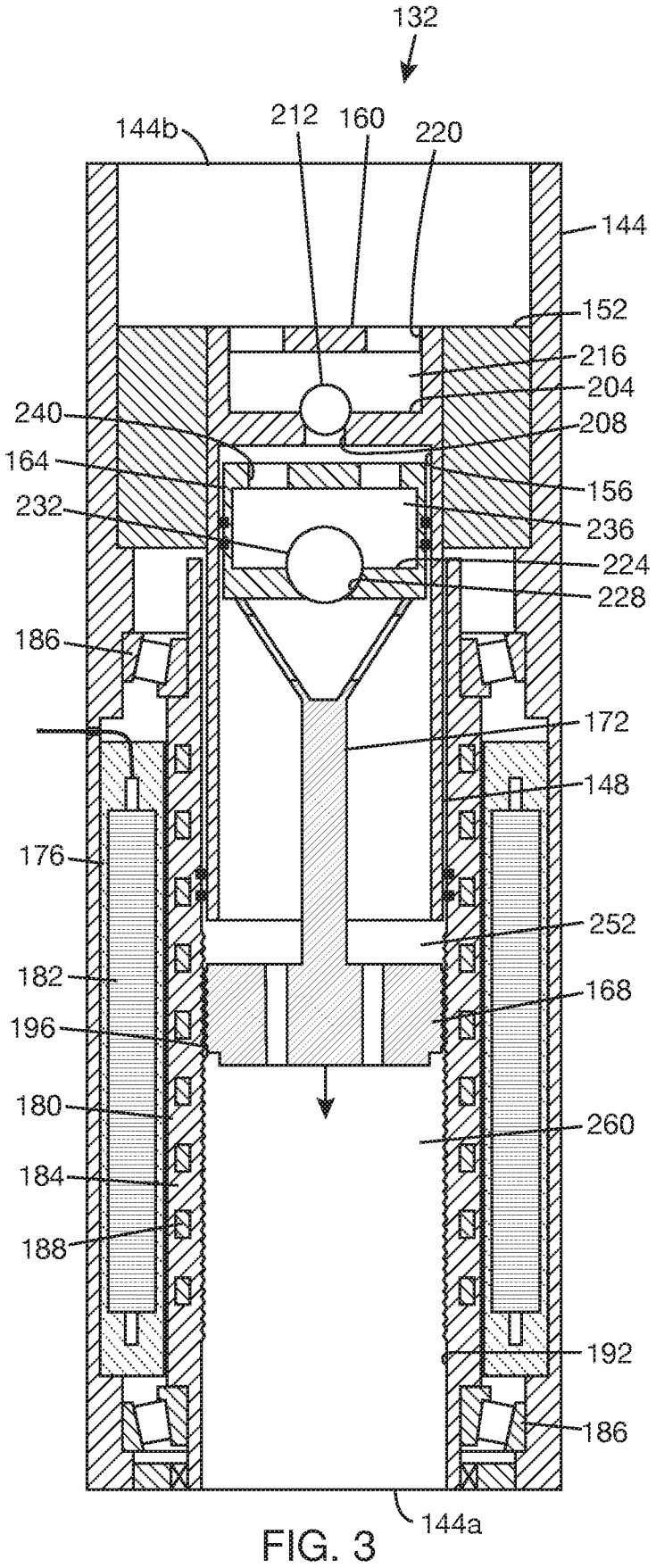
FIGS. 3-5 show the downhole pump of FIG. 1 at various stages of a pump cycle.
Figure 4:
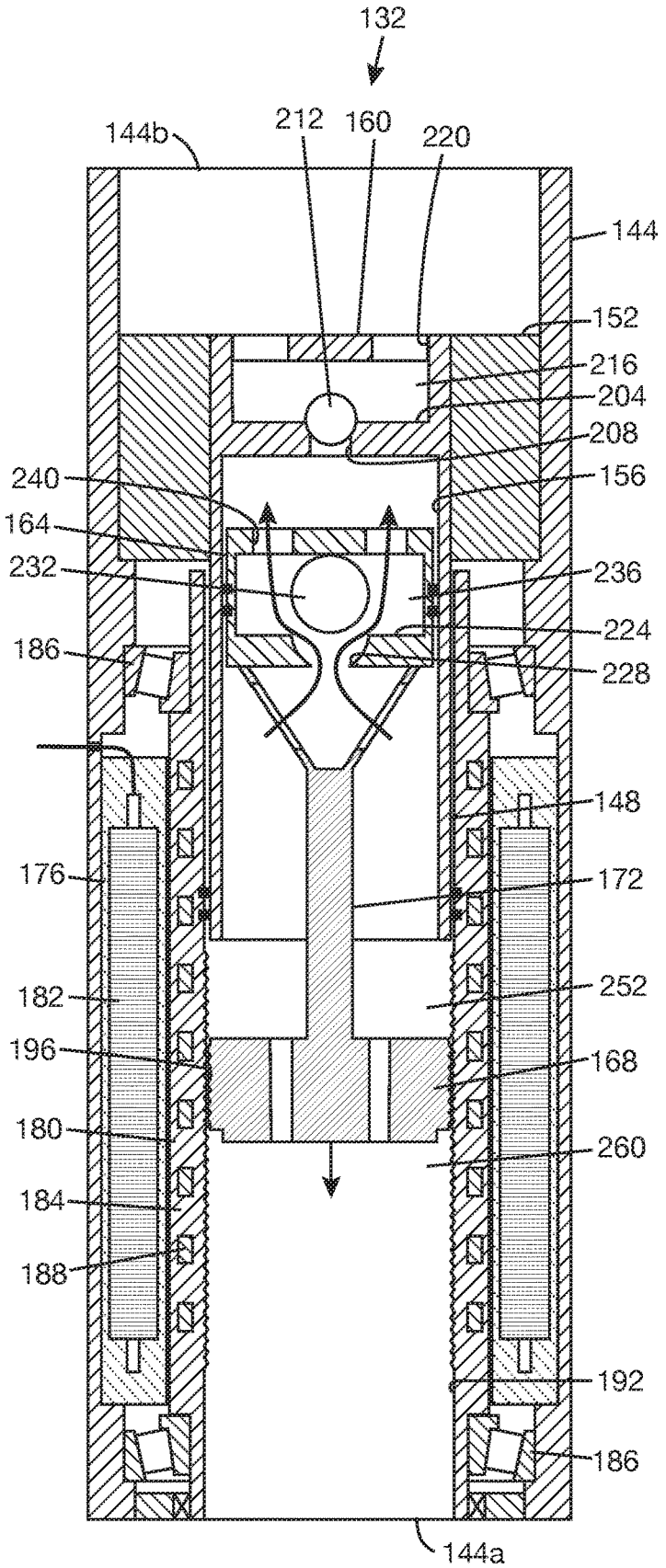
Figure 5:
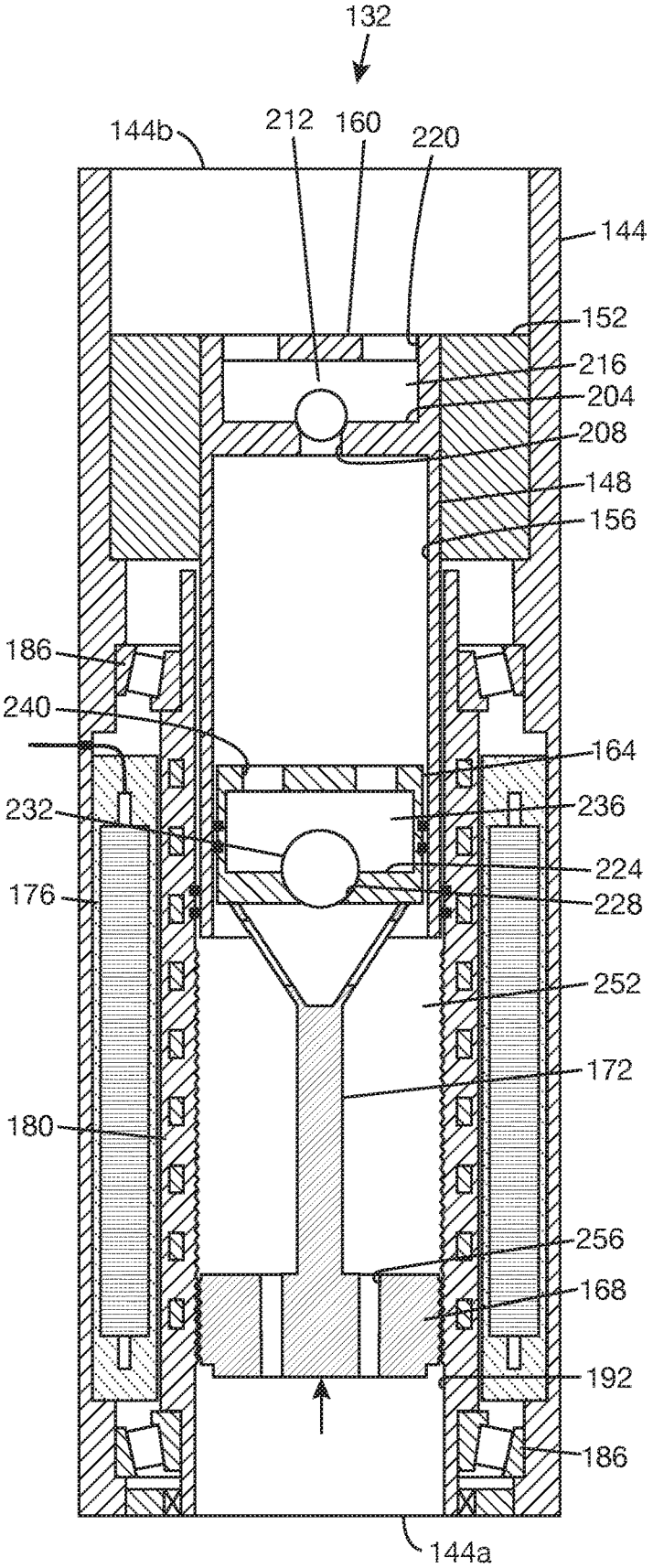

Downhole linear pump system 132 receives formation fluids from production zone (e.g., production zone 108 in FIG. 1) at pump intake 144*a*. During the drive sequence described above, traveling valve 164 and standing valve 160 alternately open and close to move the formation fluids received at pump intake 144*a* into and out of pump chamber 156. FIG. 2 shows traveling plug 168 and traveling valve 164 moving in an upward direction. The upward movement increases the pressure in pump chamber 156, lifting valve element 212 off valve seat 204, which allows fluid from pump chamber 156 to flow out through orifices 220 to the pump discharge 144*b*. FIG. 3 shows completion of the upward stroke and beginning of traveling plug 168 and traveling valve 164 moving in a downward direction. The downward movement will result in a reduction in the fluid pressure in pump chamber 156. When the pressure in pump chamber 156 is less than the pressure below traveling plug 164, valve element 232 will lift off valve seat 224, allowing formation fluid from pump intake 144*a* to enter into inlet orifice 228 and finally into pump chamber 156, as shown in FIG. 4. FIG. 5 shows the completion of the downward stroke and beginning of traveling valve 164 and traveling plug 168 moving in an upward direction. These downward and upward strokes are repeated to pump fluid.

Figure 6:
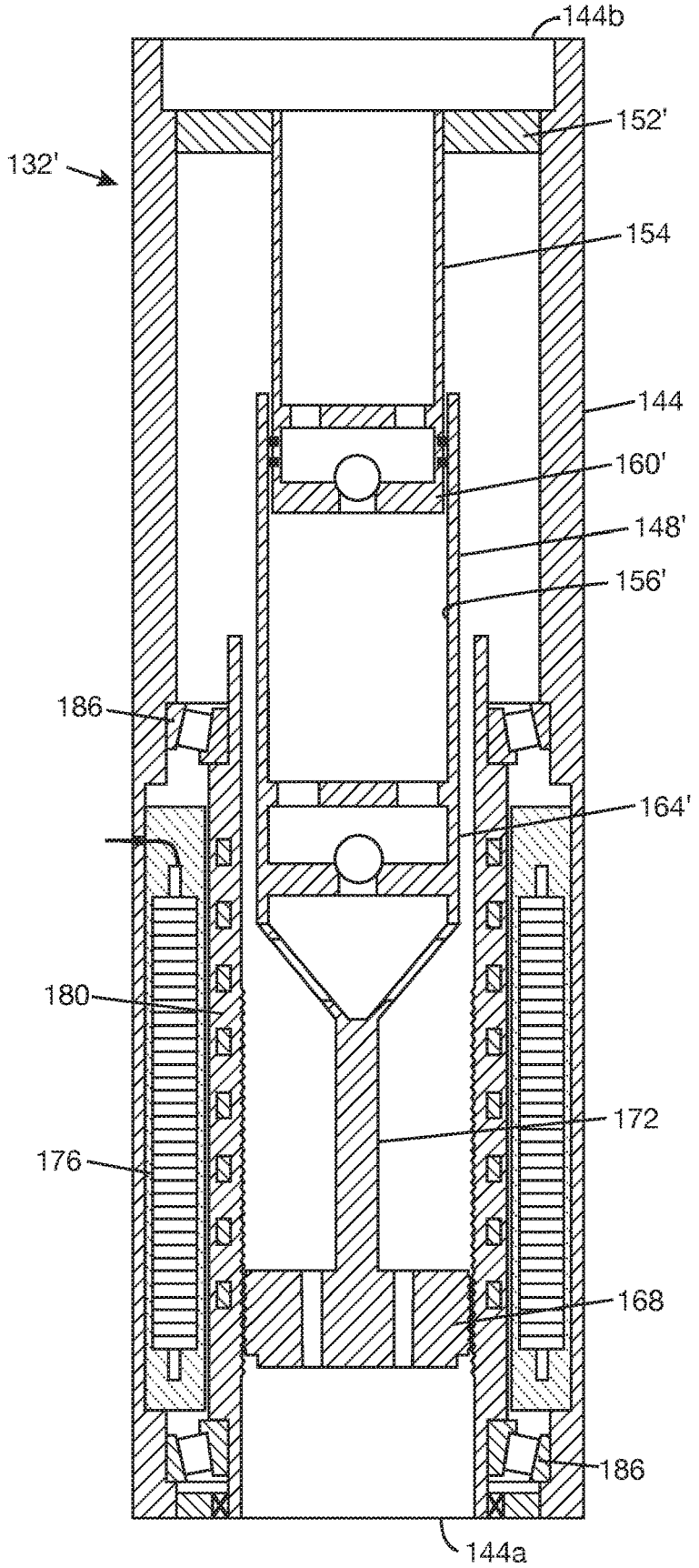
FIG. 6 is a cross-sectional view of the downhole pump of FIG. 1 according to another illustrative implementation.
Figure 7:
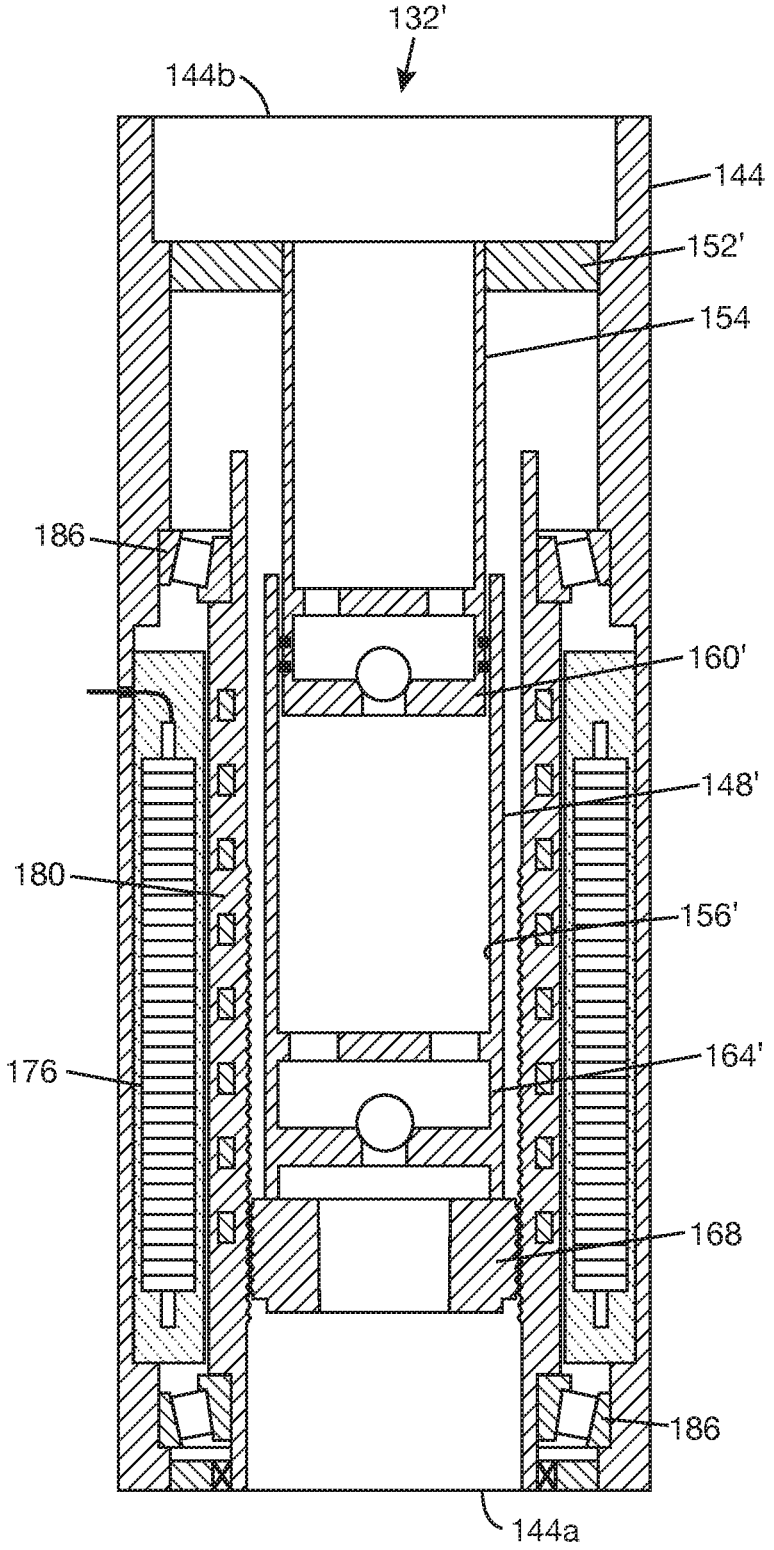
FIG. 7 is a cross-sectional view of the downhole pump of FIG. 1 according to another illustrative implementation.

In the illustrative implementation shown in FIG. 2, traveling valve 164 is coupled to traveling plug 168, and pump barrel 148 is fixed relative to housing 144. In a variation to the implementation shown in FIG. 2, a traveling pump barrel may be used instead of a fixed pump barrel, in which case the valve attached to the traveling pump barrel will be a traveling valve. This downhole pump variation 132' is illustrated in FIGS. 6 and 7. As shown, pump barrel 148' is coupled to traveling plug 168, which would allow pump barrel 148' to move relative to housing 144 as rotor 180 is rotated and traveling plug 168 moves linearly. FIGS. 6 and 7 show two options for coupling pump barrel 148' to traveling plug 168. In FIG. 6, pump barrel 148' is attached to actuator arm 172, which is attached to traveling plug 168. In FIG. 7, pump barrel 148' is attached to traveling plug 168. A traveling valve 164' is attached to pump barrel 148' and is movable with pump barrel 148'. A standing valve 160' is disposed inside pump barrel 148' and attached to housing 144. Standing valve 160' is fixed relative to housing 144. For example, standing valve 160' may include a sleeve 154 that is attached to housing 144 by, e.g., an attachment flange 152'. Pump chamber 156' is defined inside pump barrel 148' and between traveling valve 164' and standing valve 160'. Traveling valve 164' will move relative to standing valve 160' by linear motion of traveling plug 168. As previously described, rotation of rotor 180 in a rotating electromagnetic field produced by stator 176 is converted to linear motion of traveling plug 168 via a threaded engagement between traveling plug 168 and rotor 180. The downhole pump variation shown in FIG. 6 will work in the same manner described for the implementation of FIG. 2, with the valves 160' and 164' alternately opening and closing to pump fluids into and out of pump chamber 156'.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A system, comprising:

a housing having a first end corresponding to a pump intake and a second end corresponding to a pump discharge;

a pump barrel disposed within the housing, the pump barrel defining a pump chamber;

a standing valve disposed at a first end of the pump chamber, the standing valve having a valve body that is stationary relative to the housing;

a traveling valve disposed at a second end of the pump chamber, the traveling valve having a valve body that is movable along an axial axis and relative to the housing;

a motor stator disposed within the housing, the motor stator to receive electrical power and produce a rotating electromagnetic field from the electrical power;

a motor rotor rotatably supported within the motor stator, the motor rotor having characteristics to rotate about the axial axis in response to the rotating electromagnetic field, wherein the motor rotor comprises a rotor body having a bore and a first threaded surface exposed to the bore; and a traveling plug coupled to the valve body of the traveling valve and arranged to move linearly along the axial axis in response to rotation of the motor rotor.

2. The system of claim 1, wherein the traveling plug is disposed within the bore, and wherein the traveling plug has a second threaded surface in opposing relation to the first threaded surface and threadedly engaged with the first threaded surface.

3. The system of claim 2, wherein the traveling plug comprises at least one orifice providing a path for passage of fluids from the pump intake into a space adjacent to the traveling valve.

4. The system of claim 3, further comprising an actuator arm coupling the traveling plug to the traveling valve.

5. The system of claim 4, wherein the actuator arm is disposed in the space, the space is in communication with the pump intake through the at least one orifice in the traveling plug, and the actuator arm comprises at least one fluid path connecting the space to an orifice in the valve body of the traveling valve.

6. The system of claim 3, wherein the valve body of the standing valve is coupled to the pump barrel, and wherein the pump barrel extends into the bore of the rotor body.

7. The system of claim 3, wherein the valve body of the traveling valve is coupled to the pump barrel, wherein the pump barrel is coupled to the traveling plug to move with the traveling plug, and wherein the valve body of the standing valve is coupled to the housing.

8. The system of claim 2, wherein the rotor comprises one or more permanent magnets carried by the rotor body, and wherein the stator comprises windings and lamination.

9. The system of claim 8, wherein the windings and lamination are encapsulated in an electrically insulating material.

10. The system of claim 8, further comprising a motor drive to supply the electrical power to the windings.

11. The system of claim 10, wherein the motor drive comprises a three-phase alternating current variable speed drive.

12. A system, comprising:

a tubing disposed in a wellbore traversing a producing zone in a subsurface;

a downhole pump system disposed in the wellbore and positioned to lift formation fluids from the producing zone up the tubing, the downhole pump system comprising:

a housing having a first end corresponding to a pump intake and a second end corresponding to a pump discharge;

a pump barrel disposed within the housing, the pump barrel defining a pump chamber;

a standing valve disposed at a first end of the pump chamber, the standing valve having a valve body that is stationary relative to the housing;

a traveling valve disposed at a second end of the pump chamber, the traveling valve having a valve body that is movable along an axial axis and relative to the housing;

a motor stator disposed within the housing, the motor stator to receive electrical power and produce a rotating electromagnetic field from the electrical power;

a motor rotor rotatably supported within the stator, the motor rotor having characteristics to rotate about the axial axis in response to the rotating electromagnetic field, and comprising:

a rotor body having a bore; and a first threaded surface exposed to the bore;

a traveling plug coupled to the valve body of the traveling valve and arranged to move linearly along the axial axis in response to rotation of the motor rotor, the traveling plug being disposed within the bore, wherein the traveling plug has a second threaded surface in opposing relation to the first threaded surface and threadedly engaged with the first threaded surface; and a motor drive positioned at a surface location above the wellbore, the motor drive to supply the electrical power to the stator.

13. The system of claim 12, wherein the motor rotor comprises one or more permanent magnets carried by the rotor body, and wherein the motor stator comprises a plurality of windings and lamination.

14. The system of claim 12, further comprising an actuator arm connecting the traveling plug to the valve body of the traveling valve;

wherein the actuator arm is disposed in a space between the traveling plug and the traveling valve, wherein the space is fluidly connected to the pump intake through at least one orifice in the traveling plug, and wherein the actuator arm comprises at least one fluid path connecting the space to an orifice in the valve body of the traveling valve.

15. The system of claim 14, wherein the standing valve is coupled to the pump barrel.

16. The system of claim 12, wherein the valve body of the traveling valve is coupled to the pump barrel, wherein the pump barrel is coupled to the traveling plug, and wherein the valve body of the standing valve is coupled to the housing.

17. The system of claim 12, wherein the housing is coupled to the tubing.

18. A method, comprising:

disposing a pump inside a wellbore;

producing a rotating electromagnetic field by a motor stator of the pump;

rotating a motor rotor of the pump by the rotating electromagnetic field about an axial axis;

transferring the rotation of the motor rotor to a linear motion along the axial axis of a traveling plug of the pump that is disposed within a bore of and engaged with the motor rotor through a threaded surface exposed to the bore;

moving a traveling valve of the pump relative to a standing valve of the pump by the linear motion of the traveling plug; and alternately opening and closing the traveling valve and the standing valve during the moving of the valve body of the traveling valve relative to the standing valve to receive fluid into a pump chamber between the traveling valve and the standing valve and discharge fluid from the pump chamber.

* * * * *